US006257842B1

(12) United States Patent
Kawasaki et al.

(10) Patent No.: US 6,257,842 B1
(45) Date of Patent: Jul. 10, 2001

(54) SILENCER AND ELECTROMAGNETIC VIBRATING TYPE PUMP EMPLOYING THE SAME

(75) Inventors: Nozomu Kawasaki; Yasuhiro Murayama; Ikuo Ohya, all of Takatsuki (JP)

(73) Assignee: Techno Takatsuki Co., Ltd., Takatsuki (JP)

( * ) Notice: Subject to any disclaimer, the term of this patent is extended or adjusted under 35 U.S.C. 154(b) by 0 days.

(21) Appl. No.: 09/442,036

(22) Filed: Nov. 17, 1999

(51) Int. Cl.[7] ..... F04B 39/00; F04B 17/00; F02M 35/00

(52) U.S. Cl. ..... 417/312; 417/413.1; 181/229

(58) Field of Search ..... 417/312, 410.1, 417/413.1; 181/229, 237, 254, 272

(56) References Cited

U.S. PATENT DOCUMENTS 3,741,689 * 6/1973 Rupp ..... 417/393
4,897,890 * 2/1990 Walker ..... 417/413.1
5,152,579 * 10/1992 Bishai ..... 297/284.6
5,583,325 * 12/1996 Schutte et al. ..... 417/312
5,888,056 * 3/1999 Kim ..... 417/312
6,007,307 * 12/1999 Sonoda ..... 417/312

FOREIGN PATENT DOCUMENTS 8-210258 * 8/1996 (JP) .

* cited by examiner

*Primary Examiner*—Timothy S. Thorpe
*Assistant Examiner*—Michael K. Gray
(74) *Attorney, Agent, or Firm*—Armstrong, Westerman, Hattori, McLeland & Naughton, LLP

(57) ABSTRACT

A silencer assuming a shape of a sealed container in which an air reservoir is formed in a flow path from an suction inlet to an discharge outlet, wherein the air reservoir connected to the discharge outlet is provided with an exhaust valve mechanism for exhausting back-flowing air to the discharge outlet through external pressure. Since an exhaust valve mechanism for exhausting air which flows back to the discharge outlet owing to external pressure from, for instance, an air bag is provided, air can be rapidly exhausted from the air bag also in case actuation of the pump is terminated. Air pressure of the airbed can be promptly adjusted to perform adjustment of pressure of air bags or to prevent damages thereof.

4 Claims, 12 Drawing Sheets

SILENCER AND ELECTROMAGNETIC VIBRATING TYPE PUMP EMPLOYING THE SAME

BACKGROUND OF THE INVENTION

1. Field of the Invention

The present invention relates to a silencer and an electromagnetic vibrating type pump employing the same. More particularly, the present invention relates to a silencer incorporating therein an exhaust valve capable of switching an exhaust path through external air pressure and an electromagnetic vibrating type pump which is mainly employed for performing induction and exhaust of air for use in indoor air beds or air mattresses.

2. Description of the Related Art

A diaphragm type pump is an example of a conventionally known electromagnetic vibrating type pump wherein suction and discharge of fluid is performed by utilizing the vibrating force of a vibrator having permanent magnets, the vibration utilizing magnetic interaction between an electromagnet and permanent magnets. Such a pump is composed of two pairs of casings which support the diaphragm and simultaneously form a pumping chamber, a driving portion including a vibrator connected to the diaphragm and an electromagnets, a filter holding portion, and an air tank.

As shown in FIG. 11, whenever this pump 100 is utilized in an air bed B, air flowing in through suction inlet 101 is branched by discharge outlet 102 and is further introduced into air bags within a B1 zone and a B2 zone of the air bed B. For adjusting an amount of air to be introduced into each of the zones, there are respectively connected an ON/OFF type opening/closing valve 104 to each of branching paths 103*a*, 103*b*. In case operation of the pump 100 is terminated, air pressure is exerted on the B1 zone as well as the B2 zone. For this reason, there is provided another opening/closing valve 104 for emergency purposes between the branching paths 103 a and 103*b* such that the pressure can be adjusted by exhausting air within the B1 zone as well as the B2 zone. The provision of three opening/closing valves 104 and the necessity of connecting each of the opening/closing valves 104 for arranging the air bed B utilizing this pump 100 results in higher costs for arranging the same.

In an alternative bed arrangement shown in FIG. 12, the opening/closing valves 104 are replaced by two switching valves 104 which are provided with an air supply and exhaust mechanism. The number of valves used in such a bed arrangement is decreased by one so that valve-connecting operations can be performed easier. However, because the structure of the switching valves 105 are more complicated than those of the opening/closing valves 104, costs for arranging such an air bed are still high due to the increased costs of the valves.

The present invention has been made in view of these circumstance and it is an object of the present invention to provide a silencer incorporating therein an exhaust valve capable of switching an exhaust path through external pressure, and to provide an electromagnetic vibrating type pump utilizing such silencer capable of simplifying connecting operations to objects such as air beds and thereby decreasing costs for arrangement.

SUMMARY OF THE INVENTION

In accordance with the present invention, there is provided a silencer assuming a shape of a sealed container in which an air reservoir is formed in a flow path from a suction inlet to a discharge outlet, wherein the air reservoir connected to the discharge outlet is provided with an exhaust valve mechanism for exhausting back-flowing air to the discharge outlet through external pressure.

In accordance with the present invention, there is further provided an electromagnetic vibrating type pump having the above silencer wherein a diaphragm that is connected to a vibrator is made to vibrate through electromagnetic vibration of the vibrator having permanent magnets by utilizing magnetic interaction between an electromagnet and the permanent magnets.

DETAILED DESCRIPTION

Figure 1:
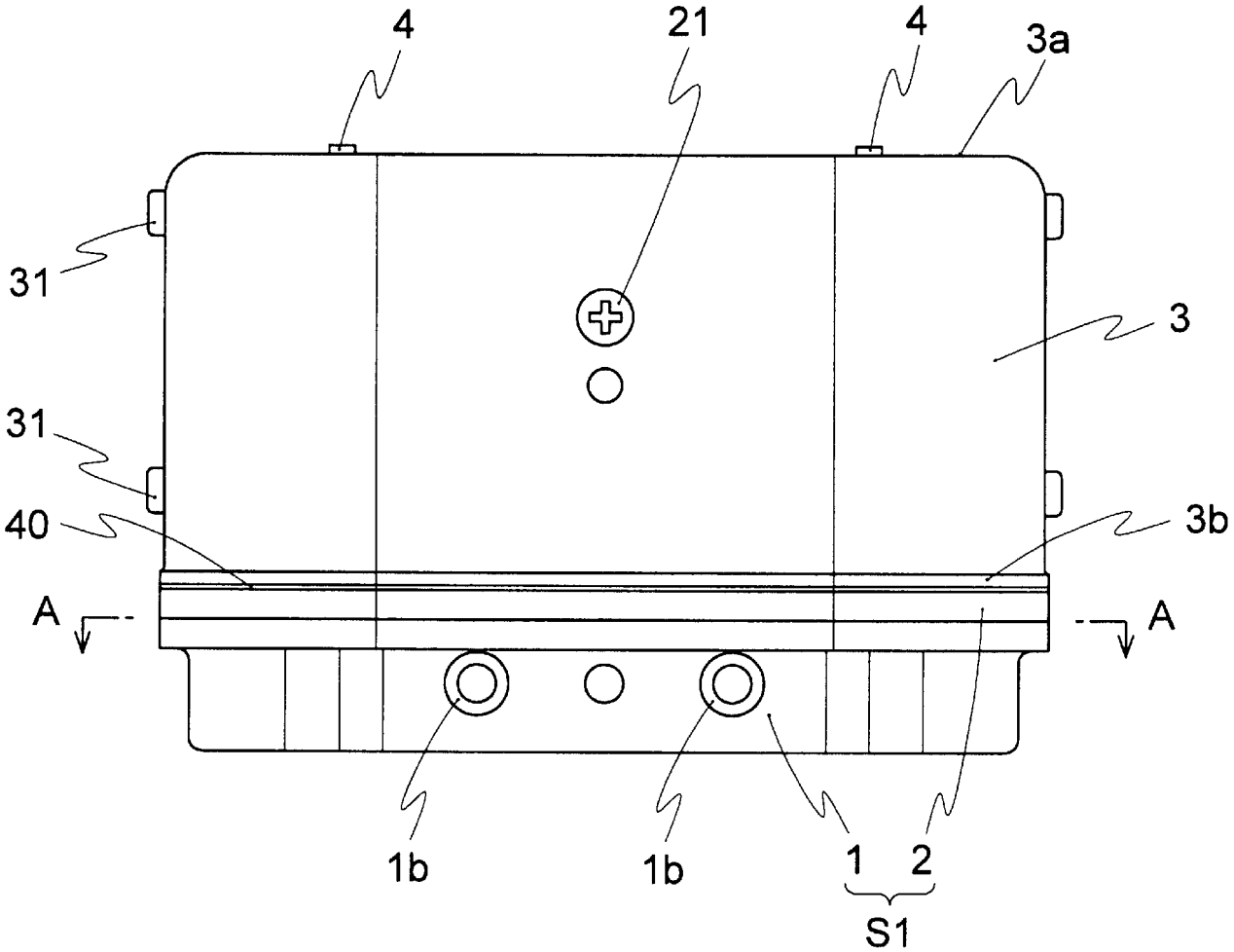
FIG. 1 is a front view showing one embodiment of an electromagnetic vibrating type pump according to the present invention.
Figure 2:
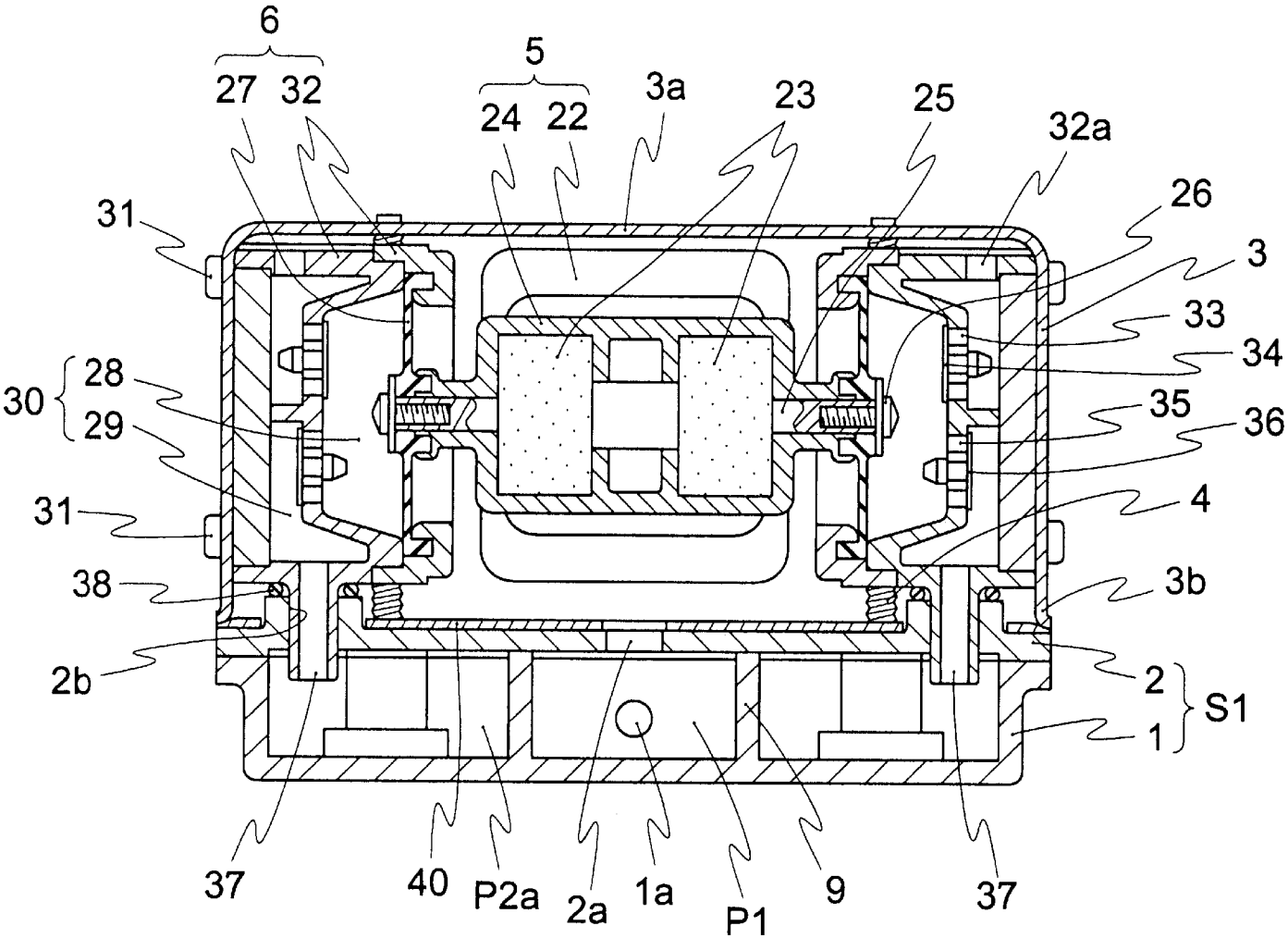
FIG. 2 is a longitudinal sectional view of the pump of FIG. 1.
Figure 3:
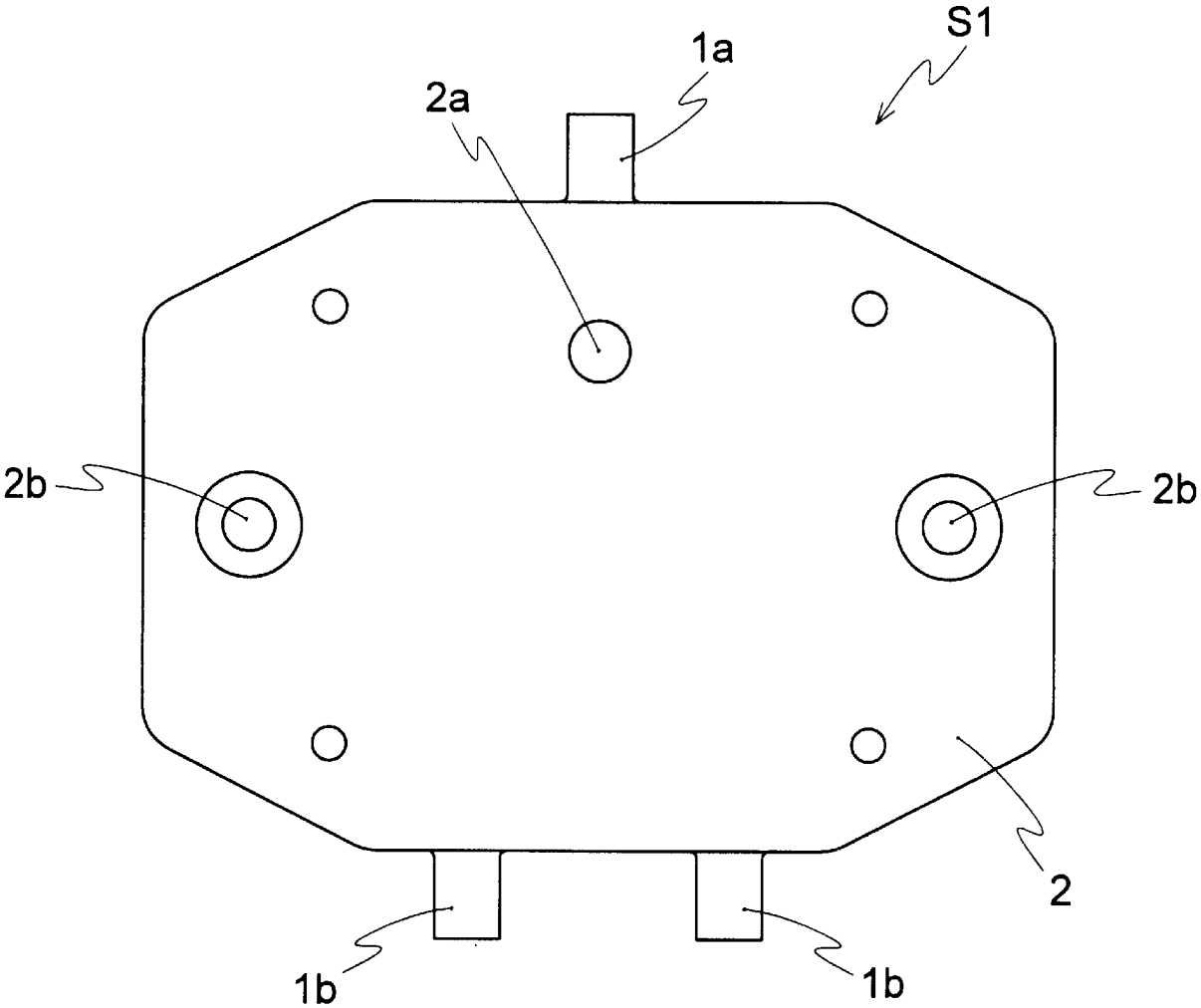
FIG. 3 is a plan view showing the silencer S1 of FIG. 1.
Figure 4:
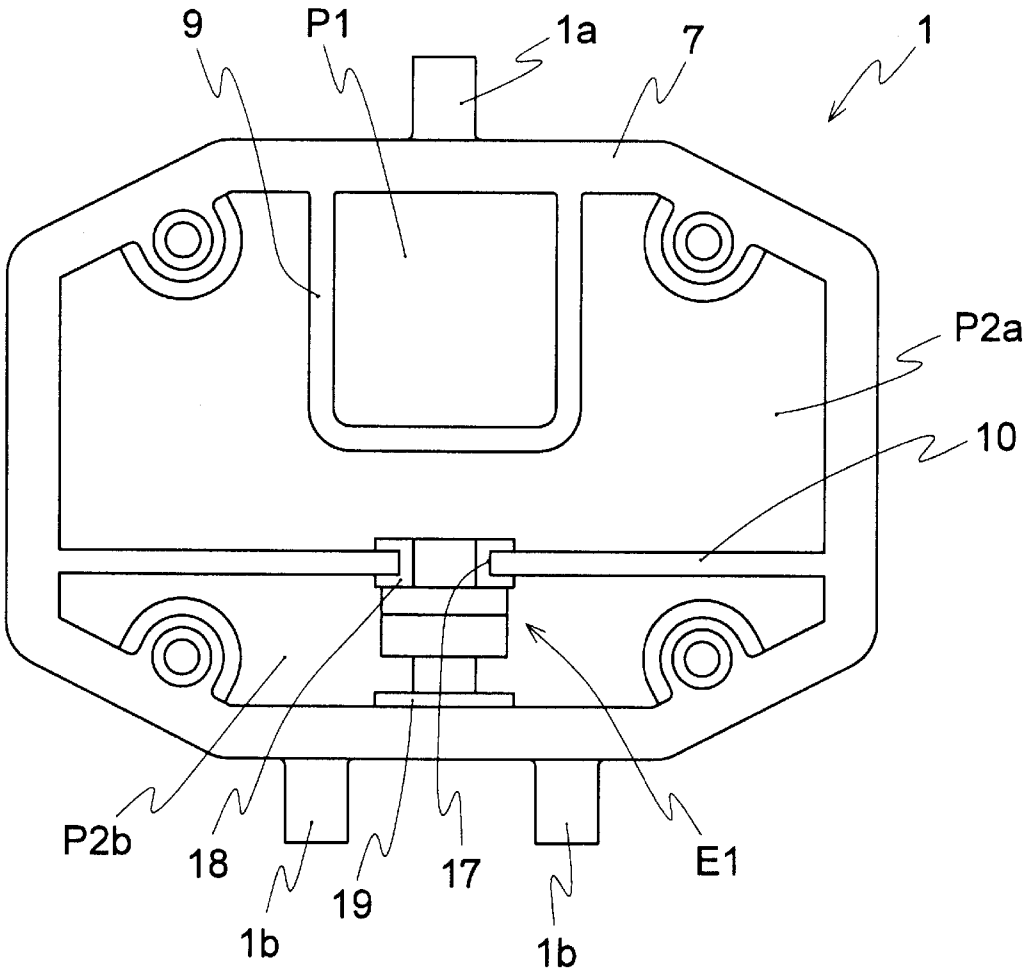
FIG. 4 is a sectional view taken along the line A—A of FIG. 1.
Figure 5:
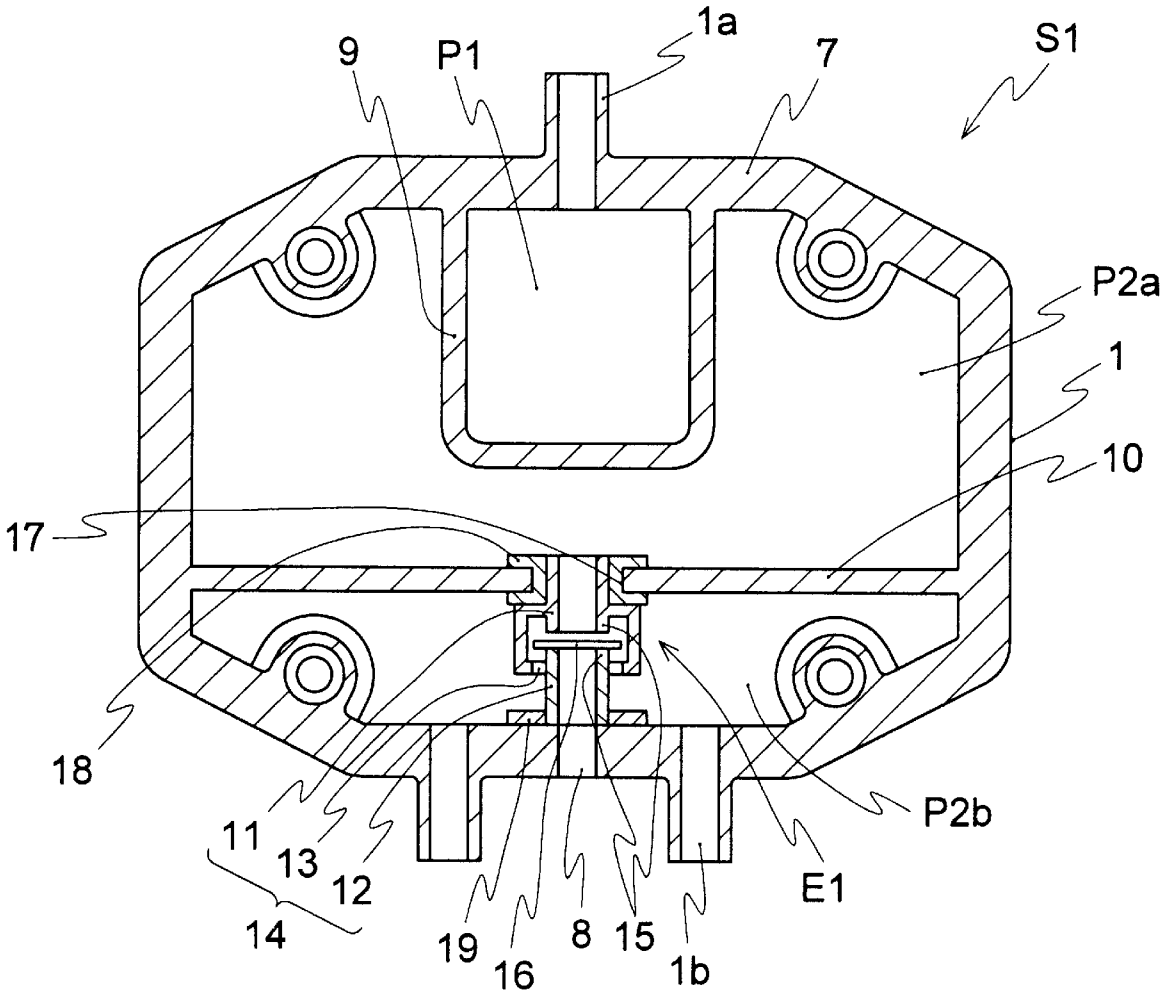
FIG. 5 is a lateral sectional view of the silencer S1.

The silencer and electromagnetic vibrating type pump employing the same according to the present invention will now be explained in details with reference to the accompanying drawings.

As shown in FIGS. 1 to 5, the electromagnetic vibrating type pump according to one embodiment of the present invention is assembled in such a manner that a bottomed case (housing) 3 is laminated onto a silencer S1 having a shape of a container and having an air tank 1 and a sealing plate 2 for sealing the air tank 1 such that a bottom portion 3*a* of the bottomed case 3 is positioned upward and the open edge portion 3*b* thereof is positioned downward, and then four bolts 4 inserted from below the silencer S1 are screwed into screw holes provided on the bottom portion 3*a*. It should be noted that the bolts 4 may be fastened by using nuts instead of screwing them into screw holes provided on the bottom portion 3*a*. The bottomed base 3 assumes a shape of an inverted bathtub or a cup. An electromagnetic driving portion 5 and a pump portion 6 are housed within the bottomed case 3.

Figure 6:
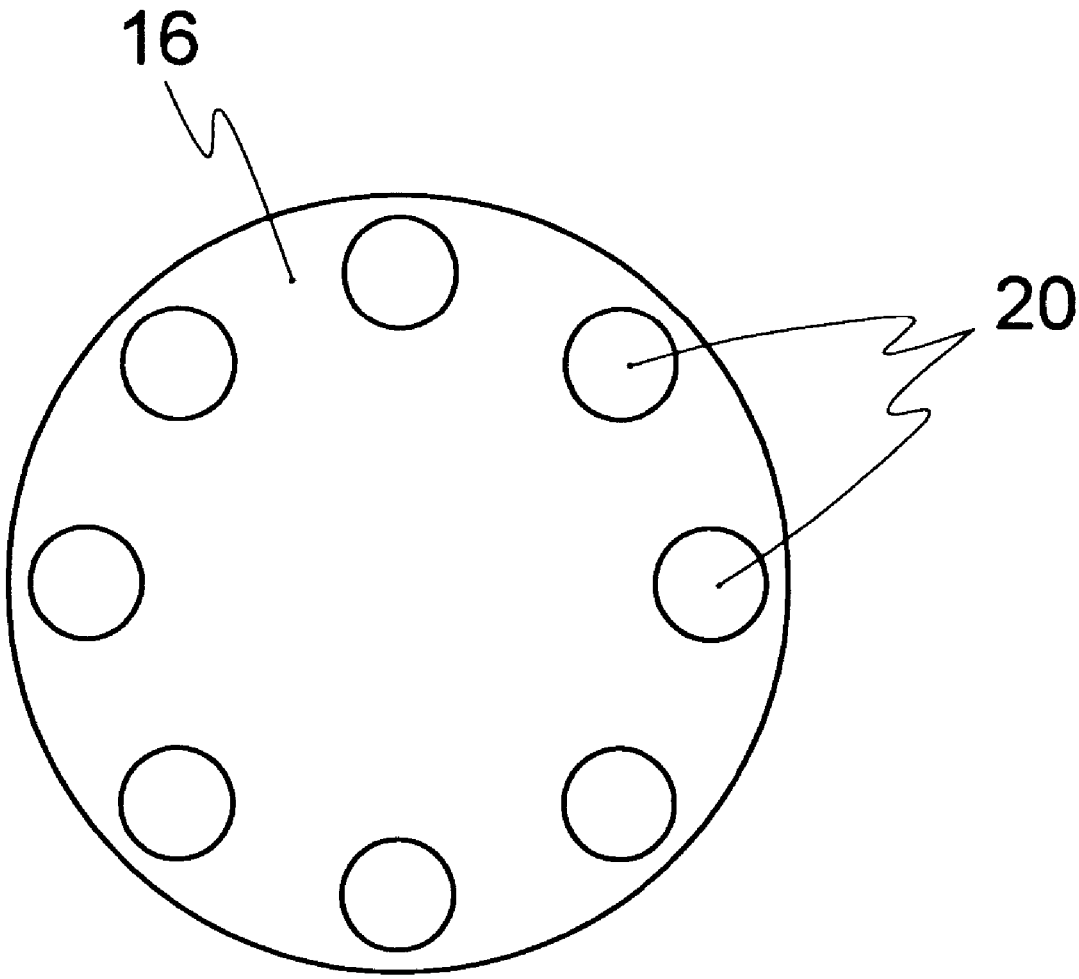
FIG. 6 is a plan view of a valve body.

The air tank 1 is fastened to the sealing plate 2 in an airtight manner through ultrasonic bonding or by using an adhesive. On an outer circumferential wall 7 of the air tank 1, there are respectively formed a suction inlet 1*a*, two discharge outlets 1*b* and an exhaust outlet 8. In an interior of the air tank 1, there are formed a suction enclosing portion 9 for forming an air reservoir P1 which is connected to the suction inlet 1*a*, a partition 10 for dividing the air reservoir connected to the discharge outlets 1*b* into two reservoirs P2*a*, P2*b*, and there is further fixed an exhaust valve mechanism E1 in a manner such that it is incorporated between the partition 10 and the outer circumferential wall 7. An air supply hole 2*a* and air exhaust portions 2*b* which are respectively connected to the air reservoirs P1, P2*a* and P2*b* are formed on the sealing plate 2. The exhaust valve mechanism E1 is composed of a main body 14 having a flow inlet portion 11, an exhaust portion 12 disposed at a position opposing the flow inlet portion 11 and a flow outlet portion 13 formed on a peripheral portion of the exhaust portion 12; a pair of valve seats 15 formed at portions opposing the flow inlet portion 11 and the exhaust portion 12; and a valve body 16 disposed at a valve chamber between the a pair of valve seats 15. Fixing of the exhaust valve mechanisms E1 is performed such that the flow inlet portion 11 is fastened to a notched portion 17 of the partition 10 with a sealing member 18 being interposed therebetween and that the exhaust portion 12 is fastened to the exhaust outlet 8 of the outer circumferential wall 7 with a sealing member 19 being interposed therebetween. The flow outlet portion 13 is formed with, for instance, eight flow outlet holes which are arranged at equal intervals around its circumference. The valve body 16 is either of disk or rectangular shape and is disposed as to be movable within the valve chamber. Air flowing in through flow inlet portion 11 can flow out through a clearance formed between the outer circumferential edge of the valve body 16 and the main body 14 due to the above arrangement. It is preferable to form, as shown in FIG. 6, a plurality of connecting holes 20 on a peripheral portion of which number corresponds to the number of flow outlet holes of the flow outlet portion 13 so that air can be evenly distributed to both discharge outlets 1*b*.

The electromagnetic driving portion 5 is composed of an electromagnet 22 which is oppositely attached to an inner circumferential wall of the bottomed case 3 by means of a machine screw 21, and a vibrator 24 disposed between the electromagnet 22 at a specified distance and having a pair of permanent magnets 23 of which lateral sections assume a rectangular shape. The electromagnet 22 might, for instance, have an E-shaped iron core formed by laminating an iron core of which section assumes a shape of the letter "E", and wiring coils assembled into two concave portions of the E-shaped iron core. The permanent magnets 23 might either be ferrite magnets or rare-earth magnets. It should be noted that it is also possible to utilize a combination of a cylindrical electromagnet and cylindrical permanent magnets.

The pump portion 6 comprises a diaphragm 27 which is attached to both ends of a rod 25 bf the vibrator 24 through machine screws 26 and a pump chamber 30 having a suction chamber 28 and a discharge chamber 29, and is further includes a pair of pump casings 32 attached to the inner circumferential wall within the bottomed case 3 through machine screws 31. The suction chamber 28 of the pump casing 32 is provided with a suction inlet 33 and a suction valve 34 and the discharge chamber 29 with a discharge outlet 35 and a discharge valve 36, respectively. On the side of the discharge outlet 35, discharge nozzles 37 are inserted into the discharge portions 2*b* of the sealing plate 2 via O rings 38.

In case the electromagnetic vibrating type pump according to this embodiment is employed for use in, e.g., an airbed, electromagnetic valves are respectively connected to both discharge outlets 1*b* of the pump and two air bags of the airbed. By making the diaphragm 27 connected to the vibrator 24 vibrate utilizing magnetic interaction between the electromagnet 22 and permanent magnets 23, air from the exterior is sucked through suction inlet 1*a* of the silencer S1 and is made to flow into the pump chamber 30 by passing through the air supply hole 2*a* of the sealing plate 2 and the air supply holes 32*a* of the pump casings 32. Thereafter, air is made to flow into the air reservoir P2*a* of the silencer S1 through the discharge nozzles 37. Upon flowing into the flow inlet portion 11 of the exhaust valve mechanism E1, the air pressure valve body 16 against the valve seat of the exhaust portion 12 and is made to flow into the air reservoir P2*a* through the outer circumferential clearance of the valve body 16. The air is then discharged from the discharge outlet 1*b* into the air bag of the bed to inflate the bed. Since the silencer S1 temporarily stores air therein, sound generated by air flowing through the silencer S1 can be decreased.

Such an air bed might be favorably used for sick persons who are forced to continuously stay in bed, since it is capable of preventing or treating bedsores as a result of congestion of blood due to partially increased pressure to some contacting portions of the bed and the body, sweating or uncleanness of the body. It is also possible to use the airbed for providing favorable and sound sleep to a person to eliminate his or her stress.

In case the actuation of the pump is terminated because of, for example, power failure, the electromagnetic valves are fully opened and the valve body 16 is moved to the valve seat 15 of the flow inlet portion 11 and is pressed thereto through external pressure (back pressure) provided through the air bags of the air bed. With this arrangement, air flowing back from the airbed to the discharge outlet 1 can be discharged through the discharge portion 12 by switching to the exterior.

It should be noted that it is preferable to provide an airtight and vibration-proof packing 40 between the silencer S1 and the bottomed case 3, which is made of, e.g., synthetic rubber or natural rubber. Further, by disposing a filter made of, e.g., felt or polyester fiber within the suction enclosing portion P1 of the silencer S1, impurities such s dust can be efficiently removed from air when passing through the filter.

Figure 7:
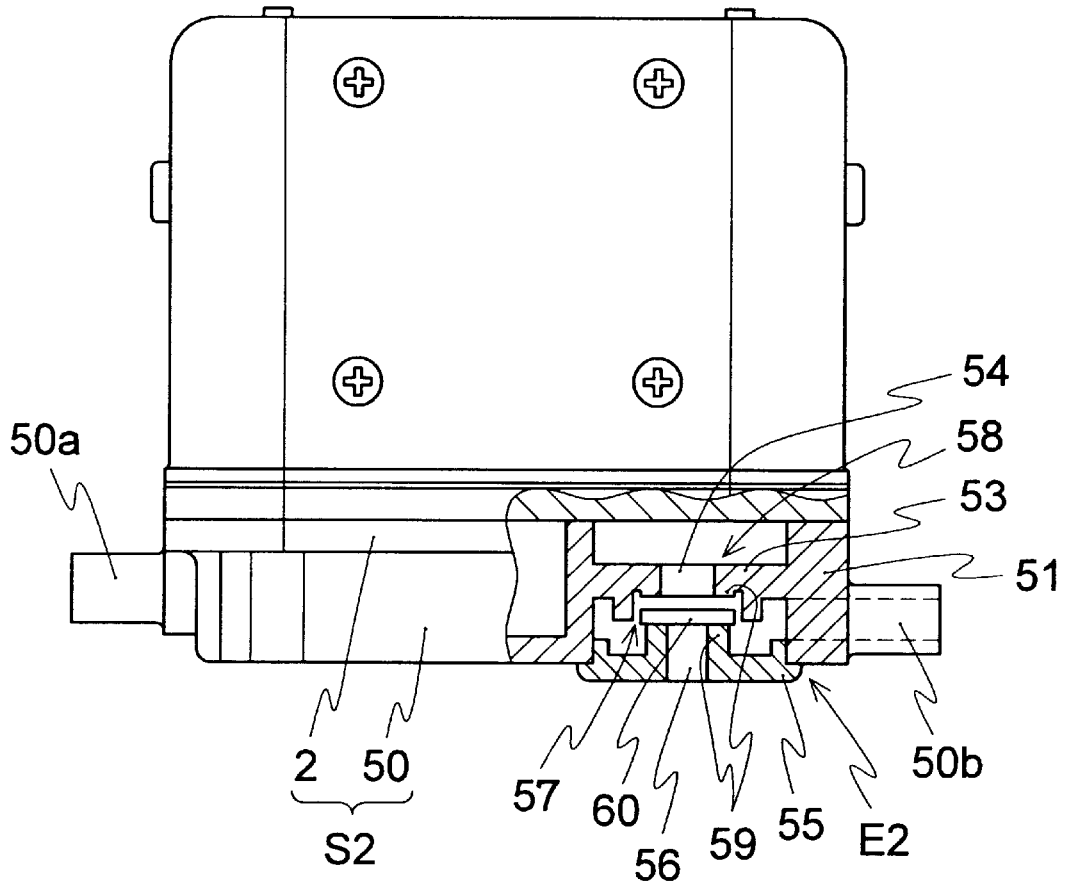
FIG. 7 is a partially cut-away side view showing another embodiment of an electromagnetic vibrating type pump according to the present invention.
Figure 8:
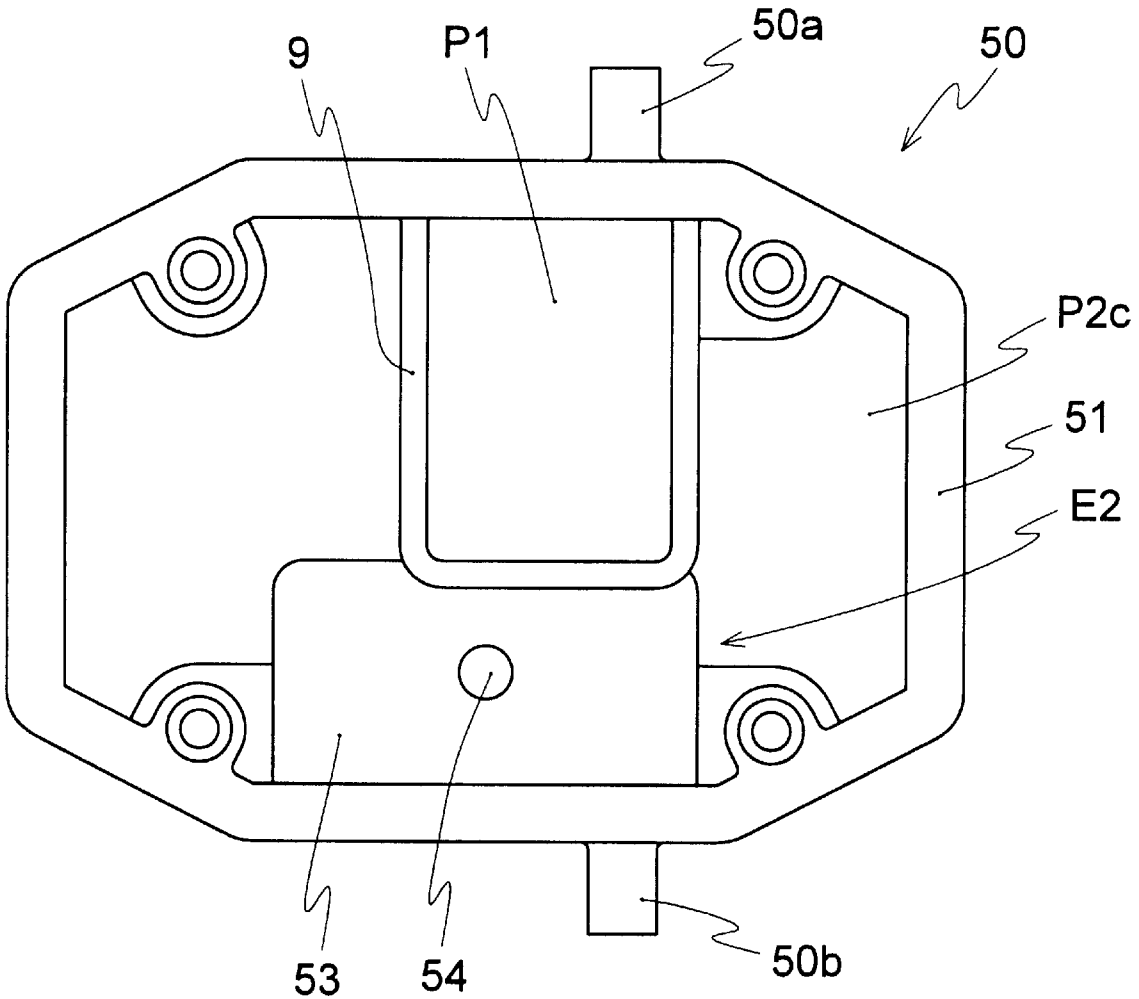
FIG. 8 is a plan view showing an interior of the silencer S2 of FIG. 7.
Figure 9:
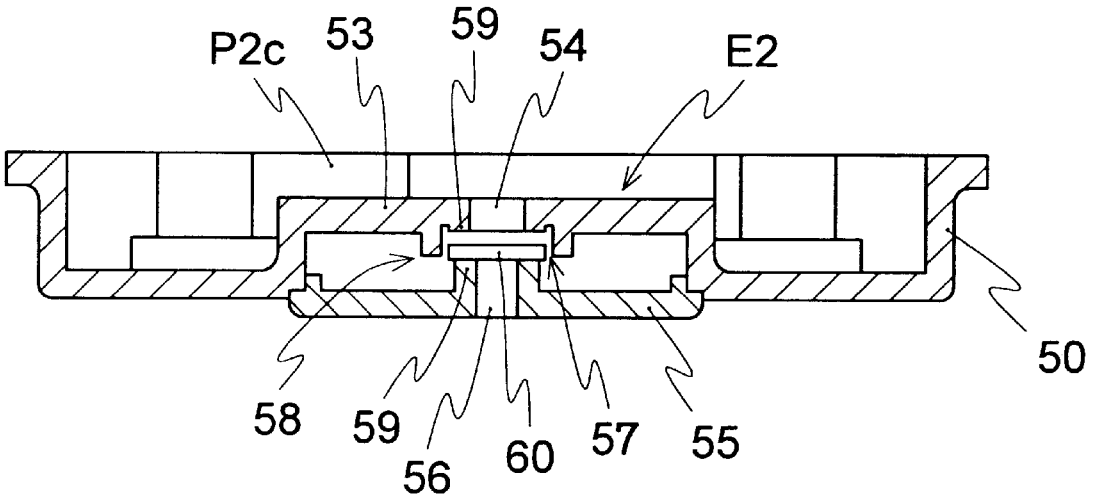
FIG. 9 is a longitudinal sectional view of an exhaust valve mechanism E2.

An alternative embodiment of the present invention will now be explained. In this embodiment, the silencer S1 is replaced by silencer S2. As shown in FIGS. 7 to 9, this silencer S2 is composed of an air tank 50 and a sealing plate 2, wherein a suction inlet 50*a* and a single discharge portion 50*b* are formed on an outer circumferential wall 51 of the air tank 50. In an interior of the air tank 50, there are formed a suction enclosing portion 52 for forming an air reservoir P1 connected to the suction inlet 50*a* and an air reservoir P2*c* connected to the discharge outlet 50*b*, wherein the air reservoir P2*c* incorporates therein an exhaust valve mechanism E2. This exhaust valve mechanism E2 is composed of a main body 58 including a flow inlet portion 54 formed at a bottom wall 53 which is formed by indenting the bottom portion of the air tank 50 inward, an exhaust portion 56 which is disposed as to oppose the flow inlet portion 54 and is formed on a lid 55 which is tightly fixed to the bottom wall 53, and a circular flow outlet portion 57 formed at a peripheral portion of the exhaust portion 56; a pair of valve seats 59 formed at opposing portions of the flow inlet portion 54 and exhaust portion 56; and a valve body 60 disposed at a clearance formed between the pair of valve seats 59. In this embodiment, a single electromagnetic valve which functions to provide flow into two directions is connected between the discharge outlet portion 50*b* and both air bags of the airbed. With this arrangement, air sucked through the suction inlet

Figure 10A:
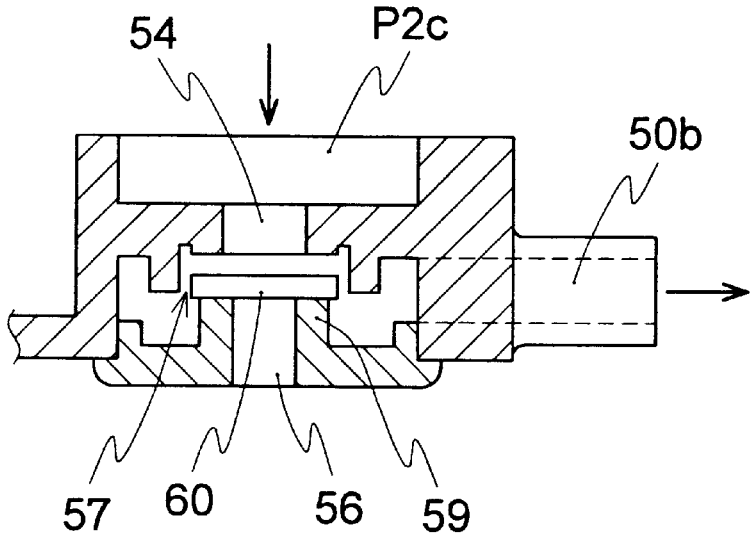
FIGS. 10(*a*) and 10(*b*) are sectional views of a major portion showing operations of the exhaust valve mechanism E2.
Figure 10B:
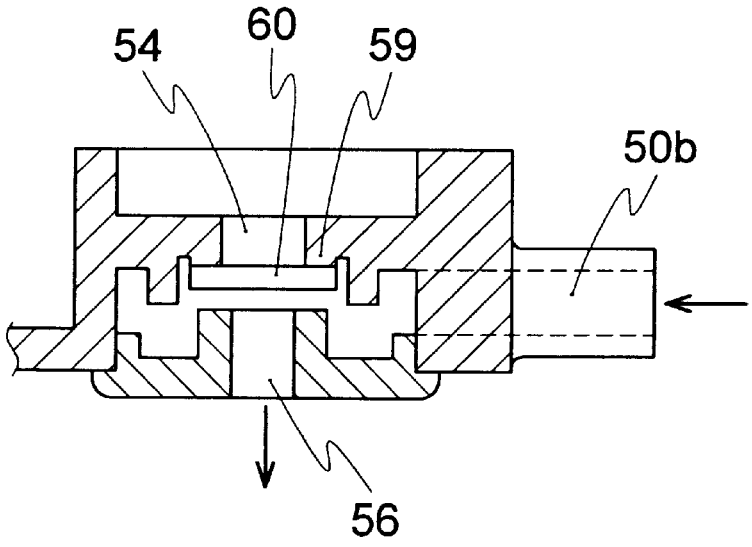
Figure 11:
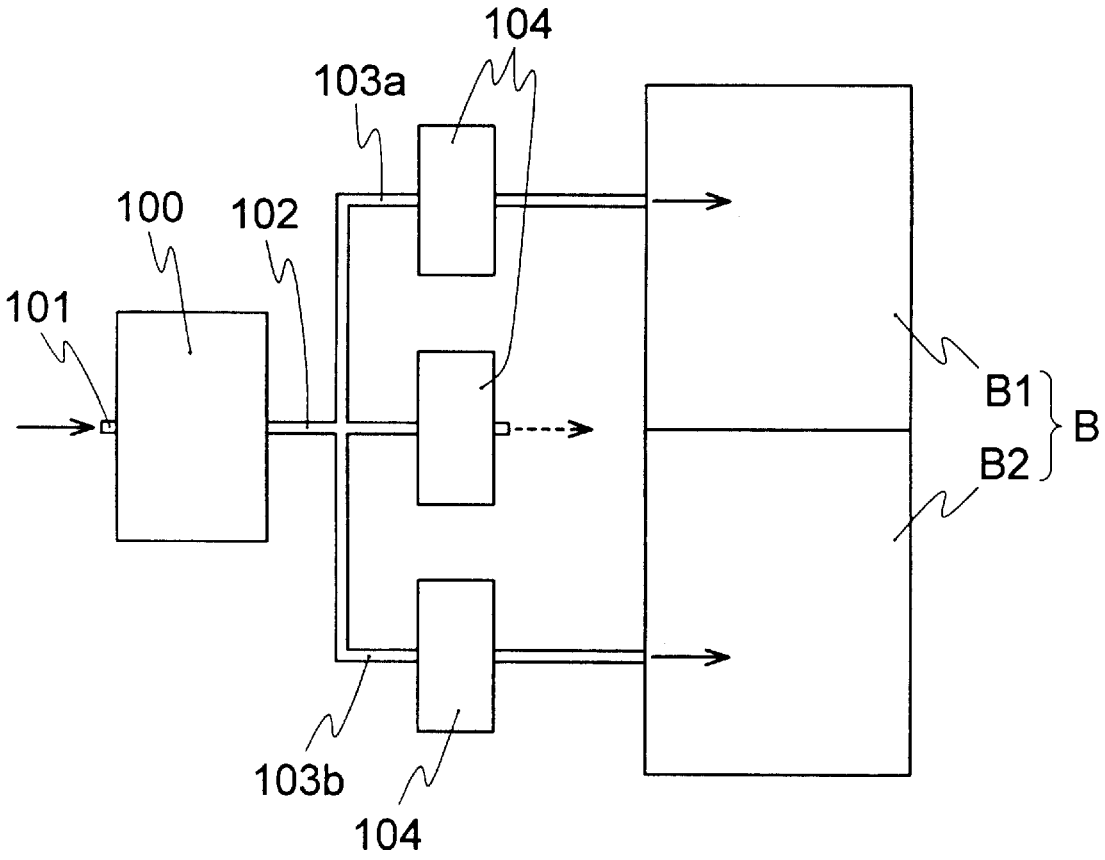
FIG. 11 PRIOR ART
FIG. 11 is a schematic view showing an example of a conventional air bed arrangement.
Figure 12:
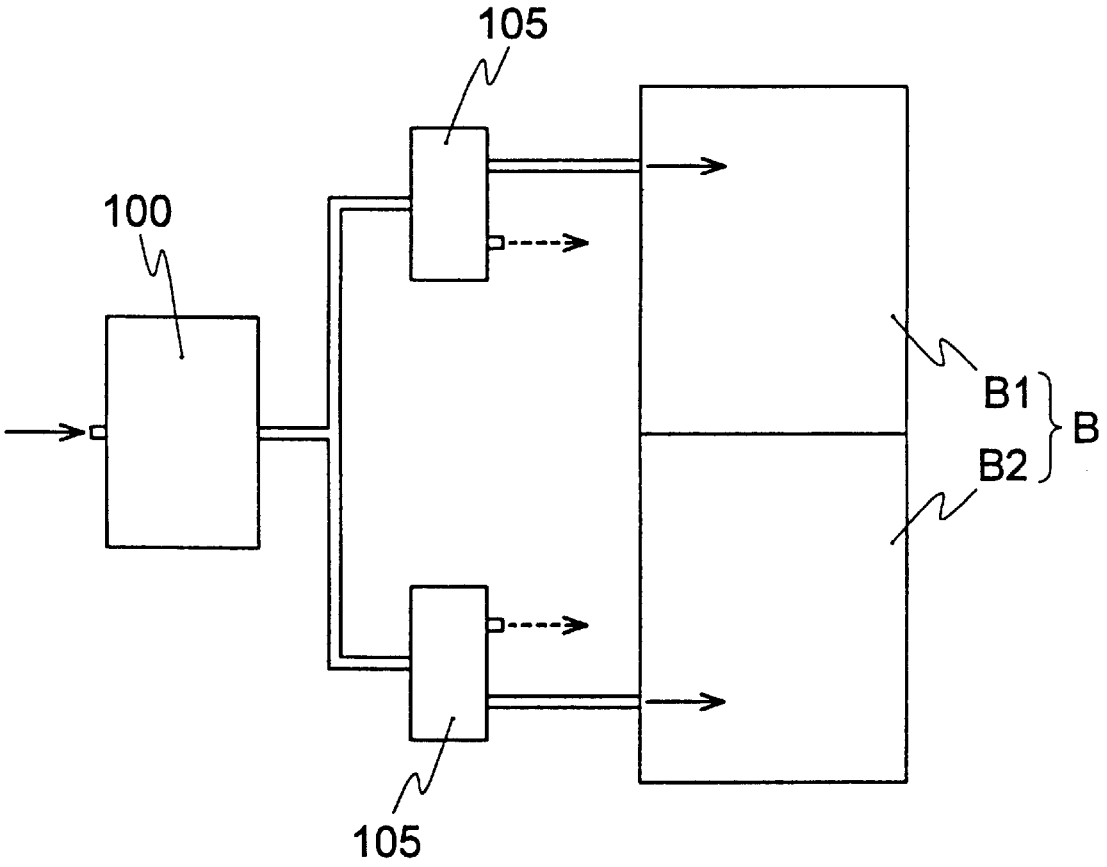
FIG. 12 PRIOR ART
FIG. 12 is a schematic view showing another example of a conventional air bed arrangement.

50*a* by ordinarily actuating the pump is made to flow, as shown in FIG. 10(*a*), from the air reservoir P2*c* to the flow inlet portion 54, presses the valve body 60 against the valve seat 59 of the exhaust portion 56 and is then discharged from the discharge outlet 50*b* to the air bags by passing through the flow inlet portion 57.

Similarly to the above-described embodiment, in case the actuation of the pump is terminated because of power failure, the electromagnetic valve is fully opened and the valve body 60 is moved to the valve seat 59 of the flow inlet portion 54 and is pressed thereto through external pressure (back pressure) provided through the air bags of the air bed, as shown in FIG. 10(*b*). With this arrangement, air flowing back from the airbed to the discharge outlet 50*b* can be discharged through the discharge portion 56 by switching to the exterior.

As compared to the silencer of the above-described embodiment, the silencer according to the present embodiment requires a lesser number of parts and only a single electromagnetic valve, the number of processes preformed for connecting the same to an air bed can be decreased and costs for arranging the bed can be further decreased as well.

As explained thus far, the silencer according to the present invention is provided with an exhaust valve mechanism for exhausting air which flows back to the discharge outlet as a result of external pressure from, for instance, an air bag so that air can be rapidly exhausted from the air bag also in case actuation of the pump is terminated. With this arrangement, air pressure of the airbed can be promptly adjusted to perform adjustment of pressure of air bags or to prevent damages thereof.

The electromagnetic vibrating type pump according to the present invention can be used to provide a bed of lower costs for arrangement by utilizing the above silencer which requires a lesser amount of parts than compared to conventional ones and which is capable of decreasing the number of processes to be performed for connection. It is also possible to perform adjustments of air pressure of an airbed in the case of deficiencies of actuation of the pump, thereby damages of air bags can be prevented.

By removing the exhaust valve and closing the discharge outlet, there can be obtained an ordinary silencer so that parts can be commonly used.

What is claimed is:

1. A silencer having a shape of a sealed container, comprising:

an air reservoir formed in a flow path from a suction inlet to a discharge outlet, wherein the air reservoir connected to the discharge outlet is provided with an exhaust valve mechanism for exhausting back-flowing air to the discharge outlet through external pressure.

2. The silencer of claim 1, wherein the exhaust valve mechanism comprises:

a main body having a flow inlet portion;

an exhaust portion disposed at a position opposing the flow inlet portion and a flow outlet portion formed on a peripheral portion of the exhaust portion;

a pair of valve seats formed at portions opposing the flow inlet portion and the exhaust portion; and a valve body disposed at a valve chamber between the pair of valve seats.

3. The silencer of claim 2, wherein a hole is formed at a peripheral portion of the valve body.

4. An electromagnetic vibrating type pump having a silencer wherein a diaphragm that is connected to a vibrator is made to vibrate through electromagnetic vibration of the vibrator having permanent magnets by utilizing magnetic interaction between an electromagnet and the permanent magnets, wherein the silencer has a shape of a sealed container, comprising:

an air reservoir formed in a flow path from a suction inlet to an discharge outlet, wherein the air reservoir connected to the discharge outlet is provided with an exhaust valve mechanism for exhausting back-flowing air to the discharge outlet through external pressure.

* * * * *